US005611709A

United States Patent [19]

McAnulty

[11] Patent Number: 5,611,709

[45] Date of Patent: Mar. 18, 1997

[54] METHOD AND ASSEMBLY OF MEMBER AND TERMINAL

[75] Inventor: Michael J. McAnulty, Longmont, Colo.

[73] Assignee: ValleyLab Inc, Boulder, Colo.

[21] Appl. No.: 513,287

[22] Filed: Aug. 10, 1995

[51] Int. Cl.[6] ..... H01R 4/26

[52] U.S. Cl. ..... 439/422

[58] Field of Search ..... 439/77, 421, 422–424, 439/492–493, 498; 174/84 C, 84 R, 88 R

[56] References Cited

U.S. PATENT DOCUMENTS

| | | | |
|---|---|---|---|
| 2,664,553 | 12/1953 | Epstein . | |
| 3,912,853 | 10/1975 | Wilkes | 439/424 |
| 3,937,549 | 2/1976 | Hughes | 439/401 |
| 3,950,065 | 4/1976 | Renn | 439/400 |
| 4,074,929 | 2/1978 | Krider | 439/400 |
| 4,420,211 | 12/1983 | Ledbetter | 439/408 |
| 4,621,305 | 11/1986 | Daum | 439/422 |
| 4,669,801 | 6/1987 | Worth | 439/404 |
| 4,679,880 | 7/1987 | Pitsch | 439/404 |
| 4,699,146 | 10/1987 | Sieverding | 128/640 |
| 4,750,482 | 6/1988 | Sieverding | 604/317 |
| 4,945,192 | 7/1990 | Urushibata et al. | 174/88 R |
| 4,957,453 | 9/1990 | Owen | 439/422 |
| 4,963,699 | 10/1990 | Urushibata et al. | 174/88 R |
| 4,995,827 | 2/1991 | Rudoy | 439/405 |
| 5,022,868 | 6/1991 | Legrady | 439/399 |
| 5,091,826 | 2/1992 | Arnett et al. | 439/404 |
| 5,151,560 | 9/1992 | Kreinberg et al. | 174/84 C |

FOREIGN PATENT DOCUMENTS

| | | | |
|---|---|---|---|
| 2254395 | 5/1974 | Germany | 174/88 R |

*Primary Examiner*—Neil Abrams
*Assistant Examiner*—Brian J. Biggi
*Attorney, Agent, or Firm*—Peter C. Richardson; Lawrence C. Akers; Aaron Passman

[57] ABSTRACT

A method and assembly for electrically and mechanically connecting one or more flexible conductive members, with one or more insulated wires using one or more insulation piercing terminals. The flexible conductive member may have one or more electrically conductive layers attached to a pliable backing. The insulated wire may have one or more conductors. The insulation piercing terminal provides a low impedance electrical connection between the flexible conductive member and the insulated wire, while also providing a mechanical connection between the flexible conductive member and the insulated wire which minimizes movement of the insulated wire due to any axial and/or longitudinal forces that may be applied to the insulated wire or the flexible member during manufacturing and use. The insulation piercing terminal combines one or more piercing members with an integral mechanical securing means and an electrical contact for engaging the flexible conductive member. The insulation piercing terminals, used in this method and assembly, eliminate the need to prepare either the flexible conductive member or the insulated wire prior to assembly. The method and assembly are of particular advantage to medical equipment manufacturers involved in designing and manufacturing flexible electrode type circuits, such as the return electrodes for use with electrosurgical generators or other electrodes or sensors associated with patient monitoring procedures and devices.

17 Claims, 7 Drawing Sheets

11
25
25
21
21
12

METHOD AND ASSEMBLY OF MEMBER AND TERMINAL

FIELD OF THE INVENTION

This pertains to the design and manufacture of flexible conductive members by providing a method and assembly for physically and electrically attaching insulated wires to a flexible conductive member, and in particular to an assembly of a flexible conductive member, an insulation piercing terminal and an insulated wire wherein the assembly is used as return electrode for electrosurgery.

BACKGROUND OF THE INVENTION

Flexible conductive members are pliable and can be flexed or shaped to meet particular application requirements. Flexible conductive members have been of particular importance to the medical community wherein patients often need to be connected to electrical monitoring or electrical generating equipment. In such applications, flexible conductive members such as return electrodes need to adapt to the shape of the patient's body in order to provide the required surface electrical contact.

Electrosurgery requires an electrosurgical generator connected to at least two electrodes to produce and deliver an electrical potential to a patient's tissue. In monopolar electrosurgery, the electrodes usually consist of an active electrode applied at the surgical site and a return electrode or pad applied to a non-surgical site on the patient.

Return electrodes are flexible conductive members and are usually manufactured to attach with a pressure sensitive adhesive directly to the surface of the patient. Return electrodes are therefore designed and manufactured to be form fitting or flexible so as to provide adequate conductive contact with the non-flat surfaces of a patient. There is typically a conductive adhesive to hold the return electrode to the patient.

Return electrodes need to be electrically connected to the source electrosurgical generator. This connection is usually provided by way of one or more insulated conductive wires which are configured to interface with the electrosurgical generator and complete the circuit. The physical connection between a wire and the return electrode must not only provide an adequate and stable conductive interface, but must also provide adequate strain relief characteristics to withstand potential mechanical forces applied to the insulated wire and/or return electrode.

Contemporary wire termination methods usually require that the ends of a wire be stripped of insulation, formed, and assembled to the flexible conductive member with a staple shaped attachment or some other attachable fastener such as a circular terminal and a rivet. The stripping process is highly dependent upon the nature of the insulation of the wire, the strip tooling design, and the tooling setup. Wire stripping problems generally result in broken wire strands or wires that cannot be formed or terminated properly in subsequent operations. Uncontrollable variables in the existing terminating process, such as those, can result in marginal or inadequate electrical and mechanical connections. Inadequate electrical connections resulting in termination impedance changes may negatively effect the performance of the overall electrosurgical system, particularly when the electrosurgical generator includes, as many do, dedicated return electrode monitoring circuitry.

In order to maintain product specifications and meet production goals, the return electrode assembly equipment must be monitored and adjusted frequently to account for the varying properties in the raw materials, especially to account for variations in the insulation characteristics of the wire.

The method, terminal and assembly described herein eliminate the need to prepare either the insulated wire or the flexible conductive member prior to assembling them. The method, terminal and assembly overcome problems with deviations found in the production of wire conductors and insulation. The method, terminal and assembly provide a low impedance electrical connection and an strong mechanical interface between the insulated wire and the flexible conductive member.

U.S. Pat. Nos. 4,679,880, 4,995,827, 4,669,801, and 5,091,826 include connectors having insulation displacement members. Each of these connectors provides an interface between an insulated wire and a rigid member such as a printed circuit board, and requires a separate clamping element to provide a stress relief by holding the wires against the insulation displacement members.

U.S. Pat. Nos. 3,950,065, 3,937,549, 4,074,929, and 5,022,868 have connectors with several insulation displacement beams or members that, when mounted on a rigid body such as a printed circuit board, provide places for electrical and mechanical interface between the body and an insulted wire. To connect an insulated wire with these connectors the wire is forced into an insulation displacement channel or opening whereby either a portion of the channel deforms, or other wire engaging elements contact the wire, to secure the wire in place.

The insulation piercing terminal connector disclosed herein can be forced through a flexible conductive member, and into and around an insulated wire in a single mechanical process. The assembly produced by this process is partly similar to that of a standard metal staple used to hold pieces of paper together. Unlike standard single wire insulation displacement connectors, the piercing members disclosed herein, which may form a conductor engaging channel, may pierce into the insulation rather than slice into the insulation. These piercing members provide a smaller overall package while also allowing a nearly gas-tight seal with the conductor and insulation.

The insulation piercing terminal and its piercing members also act to enhance user and/or patient safety by allowing the piercing members to be exposed during assembly and shielded thereafter. Thus, the piercing members of the assembly are active when required and harmless when in use. This safety feature is unknown in the prior patents.

SUMMARY OF THE INVENTION

An assembly comprising one or more flexible conductive members, one or more insulated wires and one or more insulation piercing terminals.

The flexible conductive member may have one or more electrically conductive layers attached to a pliable backing. The electrically conductive layer may be made of one or more layers of a pliable conductive material such as an aluminum, copper, steel, or precious metal alloy, or other conductive or semi-conductive coatings or layers. The pliable backing may consist of one or more layers of polyurethane or polyethylene foam, polyurethane, polyethylene, or polyester film, paper, Teflon material, cloth, leather, fiberglass, resin, rubber, or other plastic or polymer compound.

The preferred embodiment of a flexible conductive member is used as a return electrode in electrosurgery and includes a single electrically conductive layer of aluminum foil laminated to a pliable backing of closed cell cross linked polyethylene foam and a polyester film.

The insulated wire may have one or more conductors, where each conductor is electrically isolated from the other conductors. The insulated wire may come in many shapes including round, oval, flat, square, or rectangular and may consist of one or more bare or plated metallic conductors, such as copper, aluminum, precious metal, or an alloy thereof, or of conductors made of another conducting or semi-conducting material. The insulation may consist of one or more layers of a plastic, vinyl, rubber, or cloth substance, such as polyvinyl chloride (PVC), Nylon polymer, polyurethane, Teflon material, neoprene, polypropylene, or silicone. The insulated wire could also have a magnetic wire conductor perhaps having an enamel coating.

The preferred embodiment includes an insulated wire having a two 24 AWG bare copper 7/32 strand conductors covered with a PVC insulation.

The insulation piercing terminal preferably provides a low impedance electrical connection between the flexible conductive member and the insulated wire, while also providing a mechanical connection between the flexible conductive member and the insulated wire which minimizes movement of the insulated wire due to the potential axial and longitudinal forces that may be applied to the insulated wire or the flexible member during manufacturing and use.

The insulation piercing terminal may combine one or more piercing members, with an integral mechanical securing means such as a securing tab, and may also include an electrical contact for specifically engaging the flexible conductive member. The electrical contact could be a flat surface or an extended conductive material perhaps in the curved shape of a leaf spring, a rounded or oval dimple, or a punched shape such as a triangle, cross, or square.

The preferred embodiment, has an electrical contact that extends down and out from the lower side of the insulation piercing terminal and touches the electrically conductive layer and resembles a leaf spring shape in that it is a tensioned resilient contact urged downwardly and chambered midways from the lower side of the insulation piercing terminal.

The preferred embodiment of the insulation piercing terminal has at least two piercing members that extend through the flexible conductive member and into the insulated wire, thereby providing a conductor engaging channel between the two piercing members. The conductor engaging channel allows for one conductor to be compressively held between the two piercing members within the conductor engaging channel which preferably has a width equal to approximately one half the diameter of the conductor. The conductor engaging channel may have a uniform width, a tapered or narrowing width, or a variation thereof including having barbs or protrusions that engage the conductor or wire.

The insulation piercing terminal may be designed and manufactured to directly penetrate through the flexible conductive member and the insulative layers of one or more wires. The insulation piercing terminal may be formed of a continuous piece of electrically conductive metal such as tin plated bronze alloy, copper alloy, nickel alloy, brass alloy, precious metal alloy, or steel. The preferred embodiment of the insulation piercing terminal is manufactured by stamping and forming a continuous piece of a pre-tin plated phosphor bronze alloy. Several insulation piercing terminals can be produced on a band to support automation processes during final assembly.

In the assembly, the insulation piercing terminal preferably extends through the flexible conductive member to compressively hold the insulated wire against the flexible conductive member, thereby providing a mechanical interface between the flexible conductive member and the insulated wire. The insulation piercing terminal may also extend through the flexible conductive member and into the insulated wire to provide an electrically conductive connection with one of the conductors within the insulated wire.

The assembly is of particular advantage to medical equipment manufacturers involved in designing and manufacturing flexible electrode type circuits that electrically contact patient surfaces, such as the return electrodes for use with electrosurgical generators or other electrodes or sensors associated with patient treatment and/or monitoring procedures and devices.

A method for constructing the assembly may include the steps of gathering the flexible conductive member, the insulation piercing terminal and at least one insulated wire, and placing the flexible conductive member preferably between the insulation piercing terminal and the insulated wire. The method may then include the step of penetrating through the flexible conductive member with the insulation piercing terminal and piercing into the insulated wire with the insulation piercing terminal. The method may further include the step of shaping the insulation piercing terminal to compressively hold the insulated wire against the flexible conductive member. The method may include the step of covering a portion of the assembly with a non-conductive material, and/or of sealing a portion of the assembly with a corrosion protective substance. All or just a portion of this method may be automated, for example the method may include a stamped band or roll of insulation piercing terminals compatible with contemporary manufacturing devices which would, in essence, staple the flexible conductive member to the insulated wire using the insulation piercing terminal.

DETAILED DESCRIPTION OF THE INVENTION

Figure 1:
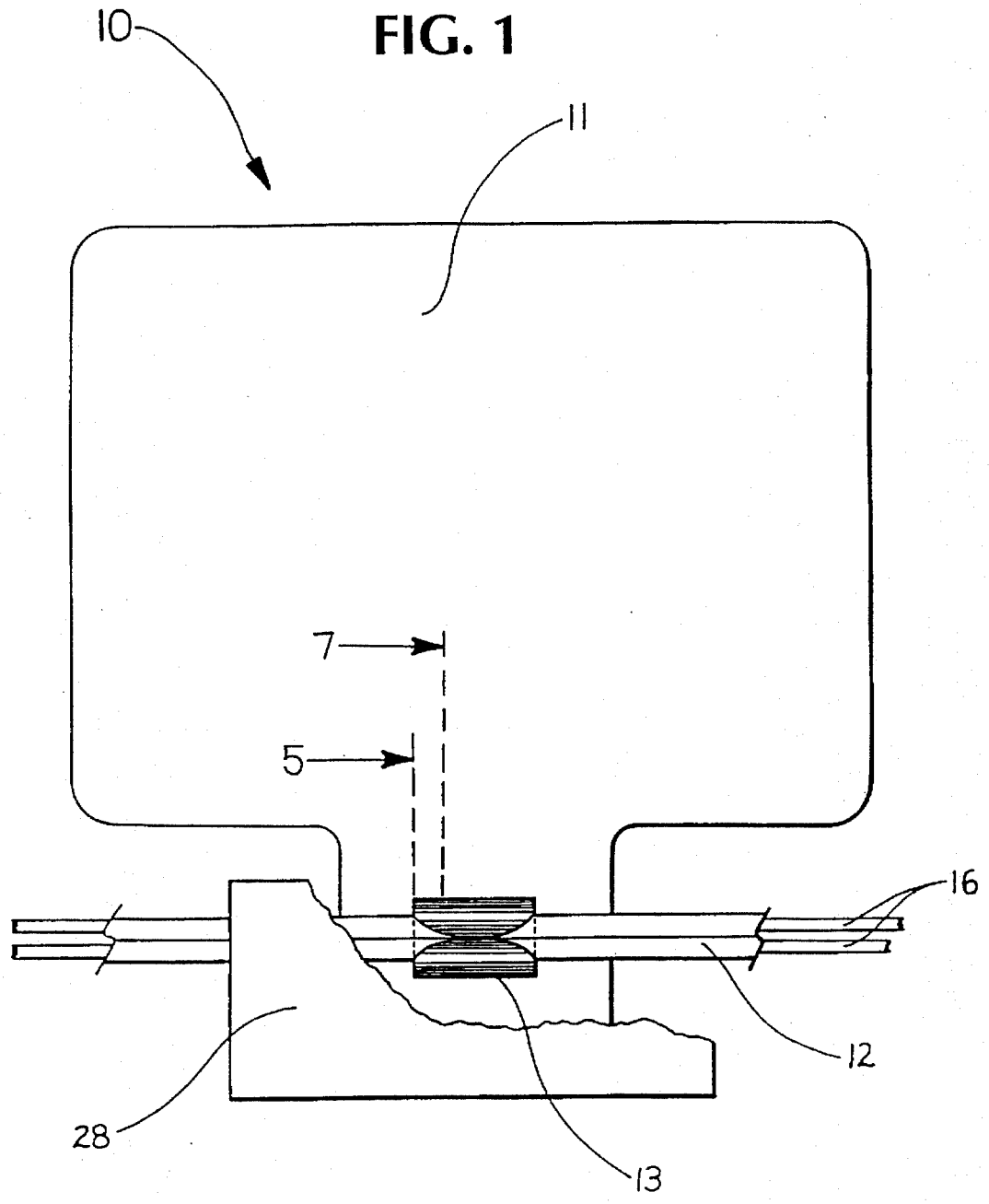
FIG. 1 is a bottom view of an assembly of a flexible conductive member, and insulation piercing terminal, and an insulated wire.
Figure 5:
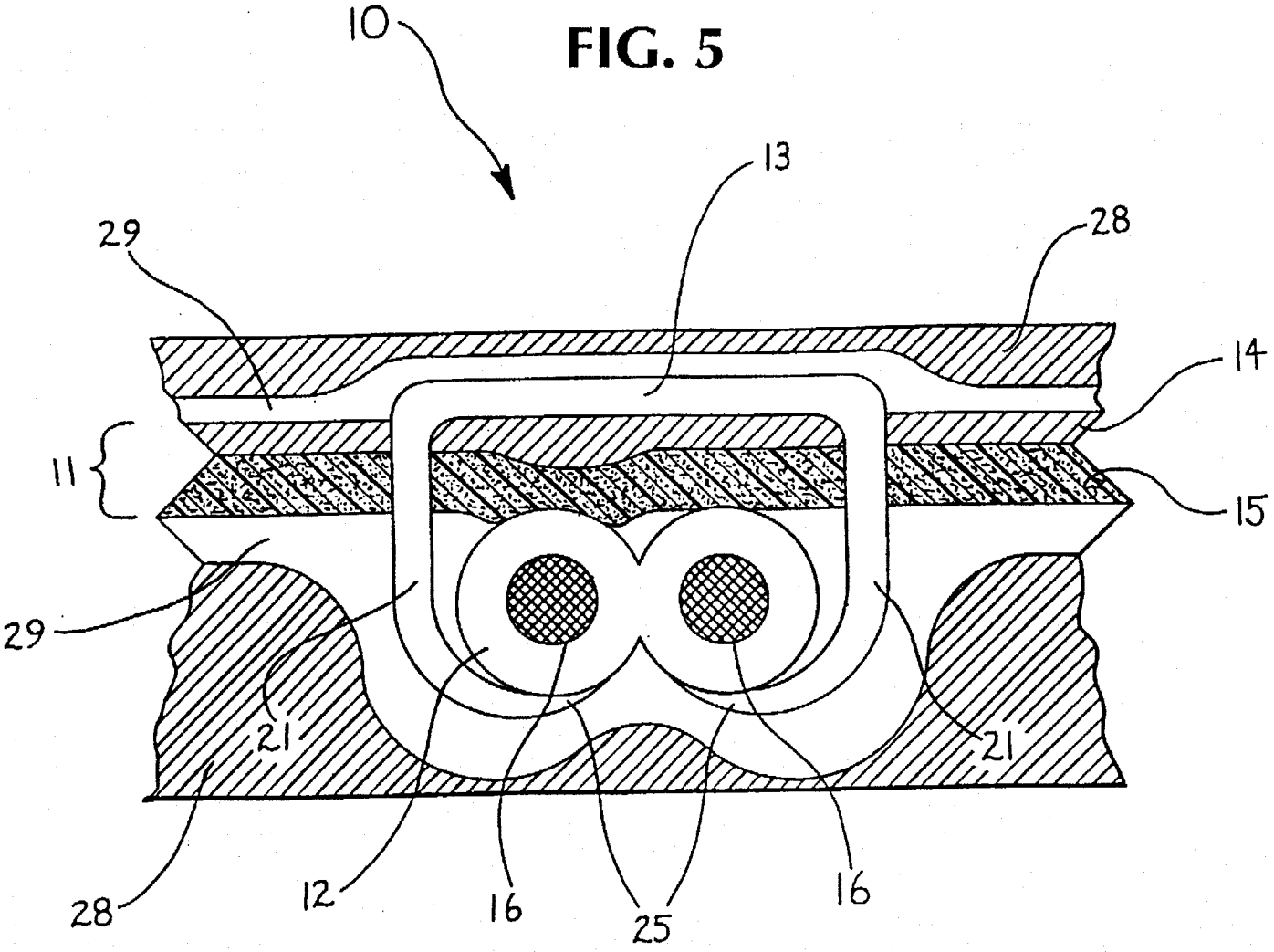
FIG. 5 is a sectional view of the assembly shown in FIG. 1, as seen from the sectional line numbered 5 thereof.
Figure 7:
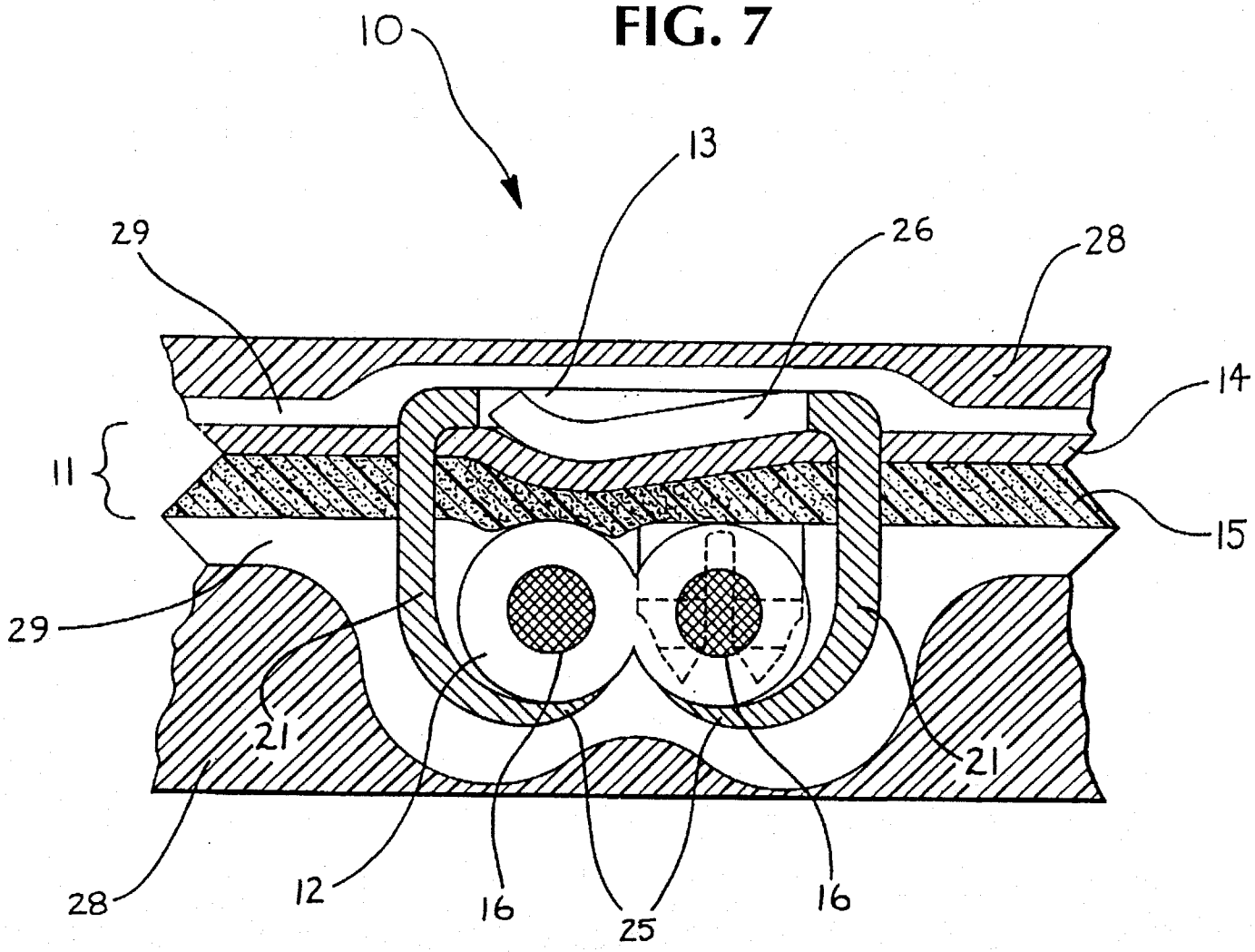
FIG. 7 is a section of view of the assembly shown in FIG. 1, as seen from the sectional line numbered 7 thereof.

An assembly 10 comprising a flexible conductive member 11, an insulated wire 12 and an insulation piercing terminal 13, as shown in FIGS. 1, 5 and 7. The flexible conductive member 11 has one or more electrically conductive layers 14 attached to a pliable backing 15. The preferred embodiment of a flexible conductive member 11, for use as a return electrode in electrosurgery, includes a single electrically conductive layer 14 preferably about 0.00035 inches thick of aluminum foil which is laminated to a polyester film about 0.004 inches thick, and a pliable backing 15 preferably about 0.031 inches thick of closed cell cross linked polyethylene foam. The assignee, Valleylab Inc. of Boulder, Colo. manufactures and sells return electrodes, for electrosurgical procedures, that are made generally according to the teachings of U.S. Pat. Nos. 4,699,146 and 4,750,482 which are made a part hereof and incorporated herein by reference.

Figure 6:
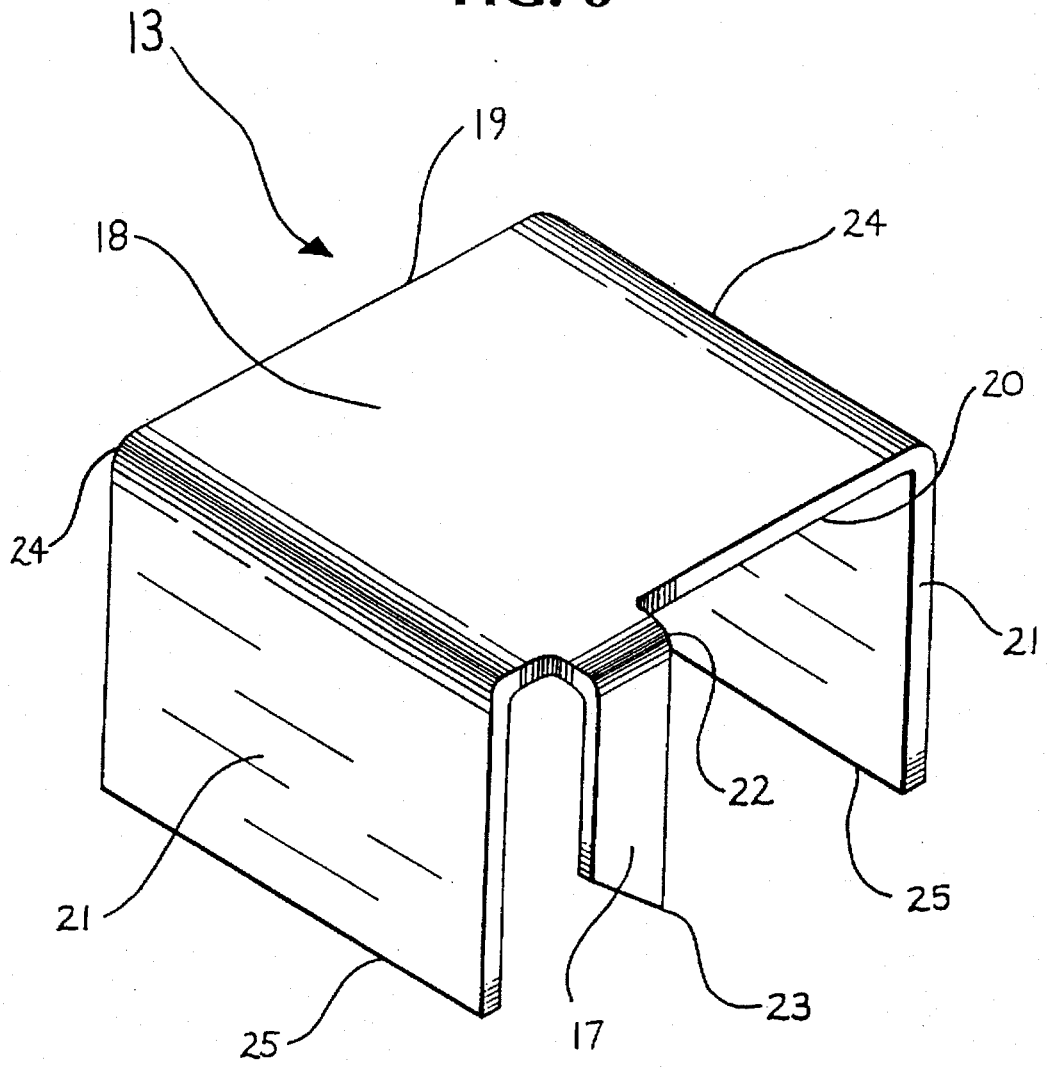
FIG. 6 is an optional embodiment of an insulation piercing terminal having a single piercing member, and without an electrical contact.

The insulated wire 12 has one or more conductors 16, where each conductor 16 is electrically isolated from the other conductors 16, as shown in FIG. 5. The preferred insulated wire 12 has two 24 AWG bare copper 7/32 strand conductors with PVC insulation. The insulation piercing terminal 13 extends through the flexible conductive member 11 and compressively holds the flexible conductive member 11 against the insulated wire 12, thereby providing a mechanical interface between the flexible conductive member 11 and the insulated wire 12. Additionally, the insulation piercing terminal 13 may have only one piercing member 17, as in shown in FIG. 6, prior to assembly, that piercing member 17 extends through the flexible conductive member 11 and into the insulated wire 12 to provide an electrically conductive connection with one of the conductors 16 within the insulated wire 12.

The insulation piercing terminal 13 includes a body 18 with an upper side 19 and a lower side 20, one or more piercing members 17 extending from the lower side 20 and at least one securing tab 21 extending from the lower side 20, as shown in FIGS. 2 through 6. The preferred embodiment of the insulation piercing terminal 13 is formed of a continuous piece of pre-tin plated phosphor bronze alloy. Each piercing member 17 has a rigid end 22 connected to the lower side 20 and a penetrating end 23 extended outwardly from the lower side 20. Each securing tab 21 has a fixed end 24 connected to the lower side 20 and a retaining end 25 extended outwardly from the lower side 20.

In the preferred assembly 10, two securing tabs 21 extend through the flexible conductive member 11, see FIGS. 1 and 5. The retaining ends 25 of these securing tabs 21 are compressively engaged against the insulated wire 12 to hold the insulated wire 12 firmly against the flexible conductive member 11. Note in FIG. 5 that the preferred penetrating ends 23 do not pierce completely through the insulated wire 12 and are, in a sense, shielded by the compressively engaged retaining ends 25 and the insulated wire 12. Therefore, the patient and the user are protected from the applied penetrating ends 23.

In the preferred assembly 10, the insulation piercing terminal 13, as shown in FIGS. 2 through 5 and 7, has an electrical contact 26 that is connected to the body 18 and extends outwardly from the lower side 20 and touches the electrically conductive layer 14, thereby providing a low impedance interface between the insulation piercing terminal 13 and the flexible conductive member 11. The preferred embodiment for the electrical contact 26 resembles a curved leaf spring shape in that it is formed as a tensioned resilient electrical contact 26 that is urged downwardly and outwardly from the lower side 20, and chambered midways from the lower side 20.

Figure 2:
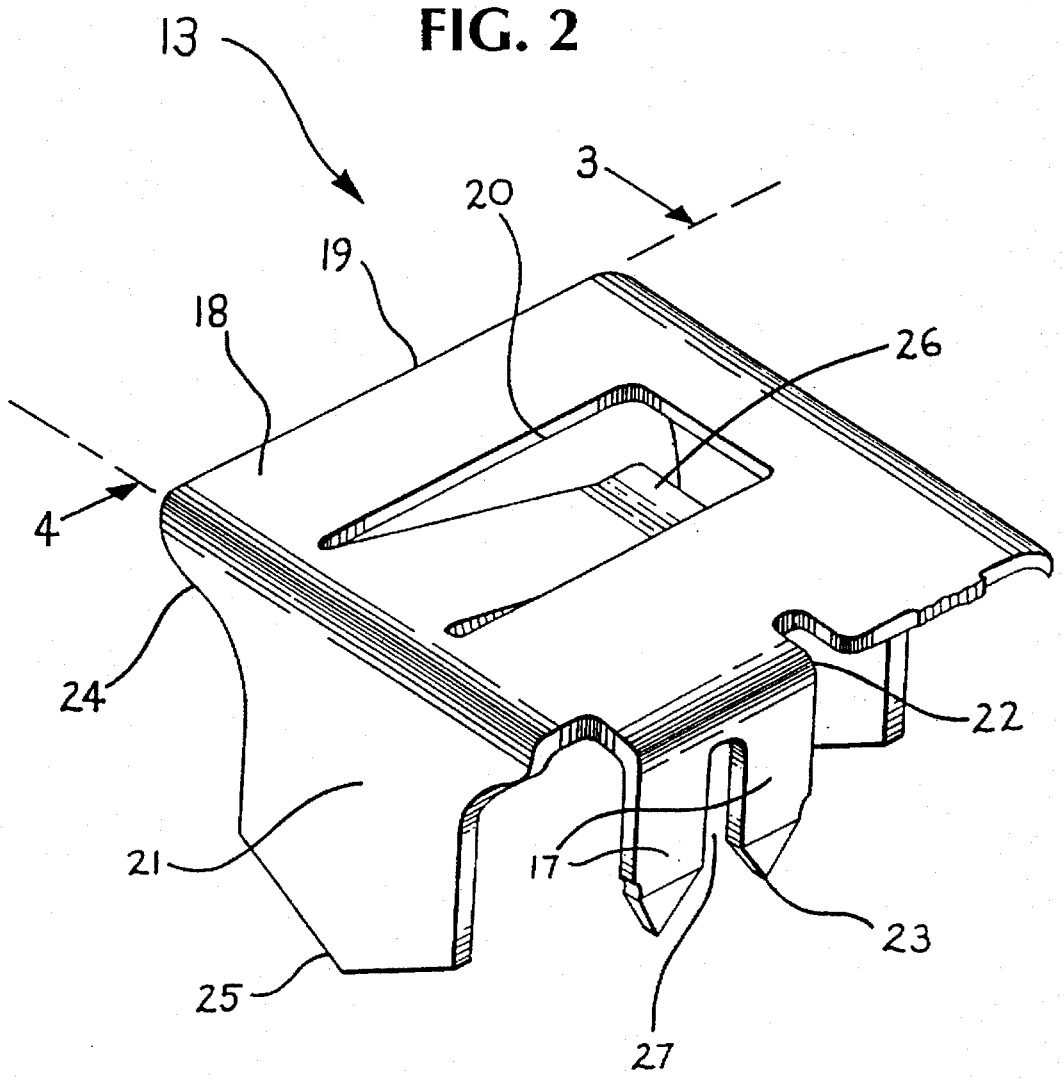
FIG. 2 is a perspective view of the preferred embodiment of an insulation piercing terminal prior to assembly.
Figure 3:
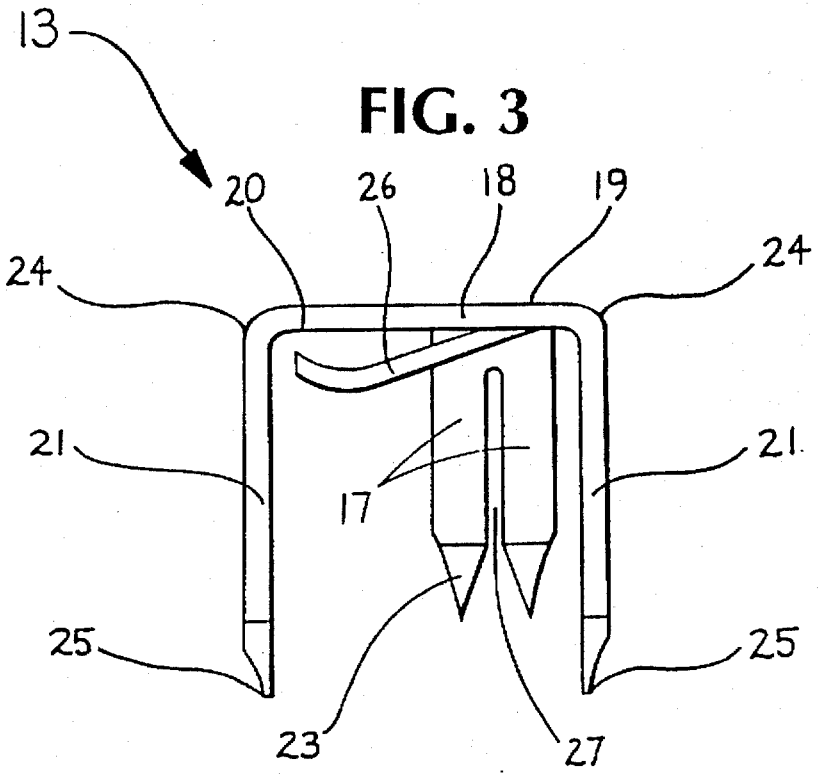
FIG. 3 is the preferred embodiment of an insulation piercing terminal as shown in FIG. 2, as seen from the perspective line numbered 3 thereof.
Figure 4:
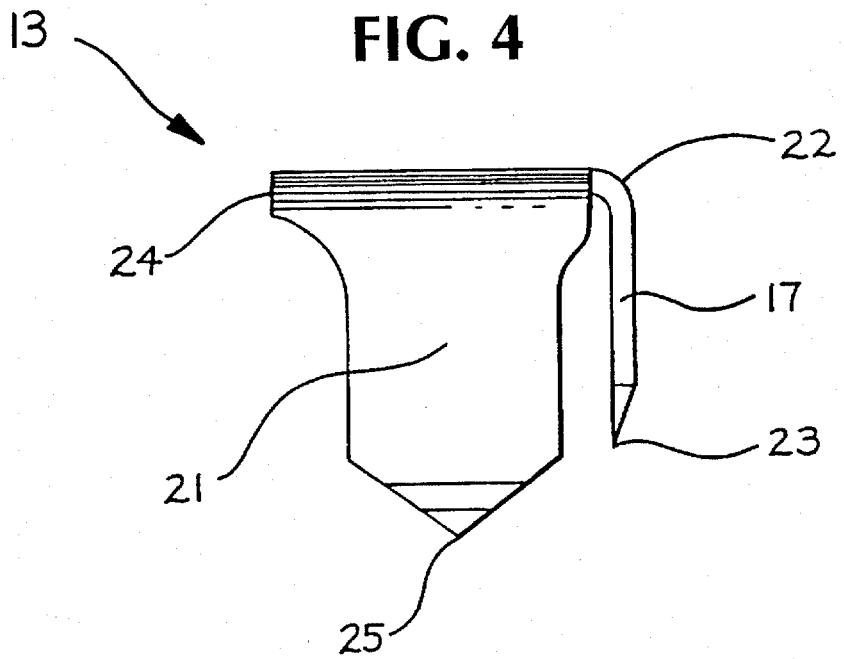
FIG. 4 is the preferred embodiment of an insulation piercing terminal shown in FIG. 2, as seen from the perspective line numbered 4 thereof.
Figure 8:
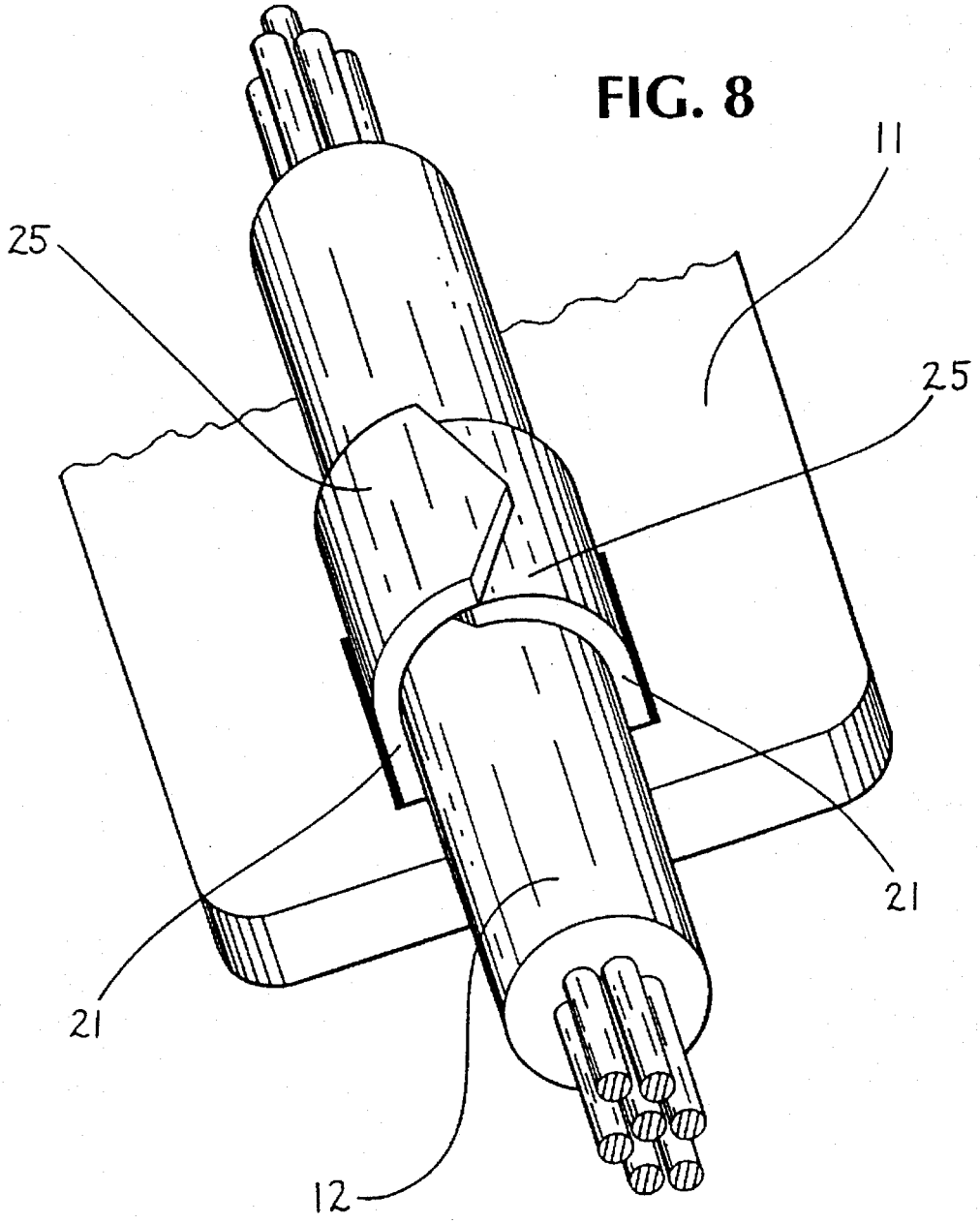
FIG. 8 is a partial perspective view of an insulation piercing terminal wrapped around a single insulated conductor shown from the part of the pad exposed when the pad is applied to a patient.

The preferred assembly 10, shown in FIGS. 1, 5 and 7, also includes insulation piercing terminal 13 having two piercing members 17, each of which extends through the flexible conductive member 11 and into the insulated wire 12, thereby providing a conductor engaging channel 27 between the two piercing members 17. The conductor engaging channel 27 is shown in FIGS. 2, 3 and 5. The conductor engaging channel 27 extends from the penetrating ends 23 towards the lower side 20 and allows for conductor 16 to be compressively held between the two piercing members 17 within the conductor engaging channel 27. The preferred embodiment of a conductor engaging channel 27 has a width equal to approximately one half the diameter of the conductor 16. The juncture between the insulated wire 12 and the piercing members 17, created during assembly when the piercing members 17 pierce through the insulated wire 12, forms a nearly gas tight seal. In FIG. 8 the alternative of a single conductor in an conductor insulated wire 12 is shown, held fast to the conductive member number 11 by retaining ends 25 of the securing tabs 21.

A method for assembling the assembly 10, as best understood and illustrated in the unassembled view of FIG. 2 and the assembled view of FIG. 5, includes the steps of gathering the flexible conductive member 11, insulation piercing terminal 13 and at least one insulated wire 12, and placing the flexible conductive member 11 preferably between the lower side 20 of the insulation piercing terminal 13 and the insulated wire 12. The method then includes the step of penetrating through the flexible conductive member 11 with one or more securing tabs 21 and one or more piercing members 17, preferably by applying a force to the upper side 19 for piercing into the insulated wire 12 with one or more piercing members 17. The method further includes the step of shaping the insulation piercing terminal 13 to compressively hold the insulated wire 12 against the flexible conductive member 11, preferably by applying a force to one or more of the securing tabs 21 near its retaining end 25 thereby causing the securing tab 21 to bend in the direction of the lower side 20 and to contact the insulated wire 12 so as to draw the insulted wire 12 towards the lower side 20 and to compressively hold the insulated wire 12 against the pliable backing 15.

Optionally, the method includes the method steps of covering a portion of the assembly 10 with a non-conductive material 28, and/or of sealing a portion of the assembly 10 with a corrosion protective substance 29. The preferred embodiment, as shown in FIG. 1, includes the step of covering a portion of the assembly 10 with a non-conductive material 28 made of an adhesive lined, closed cell cross linked polyurethane foam.

What is claimed is:

1. An assembly of a member and terminal comprising;

a flexible conductive member;

an insulated wire carrying one or more conductors therethrough;

an insulation piercing terminal, for both:

extending through the flexible conductive member, and compressively holding the flexible conductive member against the insulated wire;

a piercing member on the insulation piercing terminal extending through the flexible conductive member and into the insulated wire to engage the wire by piercing the insulation thereof for providing an electrically conductive connection with one or more conductors therein, and one or more securing tabs on the insulation piercing terminal wherein the one or more securing tabs extending through the flexible conductive member for retaining and compressively engaging against the insulated wire to hold the insulated wire against the flexible conductive member.

2. The assembly of a member and terminal in claim 1 wherein the flexible conductive member has one or more electrically conductive layers attached to a pliable backing.

3. The assembly of a member and terminal in claim 1 wherein the insulation piercing terminal includes:

a body with an upper side and a lower side;

one or more piercing members extending from the lower side, each piercing member having a rigid end connected to the lower side and a penetrating end extended outwardly from the lower side; and the one or more securing tabs extending from the lower side, each securing tab having a fixed end connected to the lower side and a retaining end extended outwardly from the lower side, wherein one or more of the securing tabs extends through the flexible conductive member with its retaining end compressively engaging against the insulated wire to hold the insulated wire against the flexible conductive member.

4. The assembly of a member and terminal in claim 3 wherein the insulation piercing terminal further includes one or more electrical contacts connected to the body and extended outwardly from the lower side for conductively contacting the electrically conductive layer.

5. The assembly of a member and terminal in claim 3 wherein the insulation piercing terminal includes:

two piercing members extending through the flexible conductive member and into the insulated wire, and a conductor engaging channel between the two piercing members extending from the penetrating ends towards the lower side, wherein a conductor is compressively held between the two piercing members within the conductor engaging channel.

6. The assembly of a member and a terminal in claim 1 further including a non-conductive material covering, the non-conductive material covering extending over the assembly.

7. The assembly of a member and a terminal in claim 1 further including a corrosion protective substance applied to seal the assembly.

8. An assembly of a member and terminal comprising:

a flexible conductive member, having an electrically conductive layer attached to a pliable backing;

an insulated wire carrying two conductors therethrough;

an insulation piercing terminal having;

a body with an upper side and a lower side;

two piercing members extending from the lower side, each piercing member having a rigid end connected to the lower side and a penetrating end extended outwardly from the lower side, wherein each of the piecing members extends through the flexible conductive member and into the insulated wire;

a conductor engaging channel between the two piercing members extending from the penetrating ends towards the lower side, wherein one conductor is compressively held between the two piercing members within the conductor engaging channel;

an electrical contact connected to the body and extended outwardly from the lower side and conductively contacting the electrically conductive layer, and two securing tabs extending from the lower side, each securing tab having a fixed end connected to the lower side and a retaining end extended outwardly from the lower side, wherein each of the securing tabs extends through the flexible conductive member and has its retaining end compressively engaged against the insulated wire to hold the insulated wire against the pliable backing.

9. An insulation piercing terminal comprising:

a body having an upper side and a lower side;

one or more securing tabs extending from the lower side, each securing tab having a fixed end connected to the lower side and a retaining end extended outwardly from the lower side;

one or more piercing members extending from the lower side;

a penetrating end at the extremity of the extended piercing member, and engaging means on the one or more piercing member to engage compressively one or more insulated wires, the engaging means designed to directly penetrate through insulation layers of the one or more wires for making electrical contact.

10. The insulation piercing terminal in claim 9 further including one or more electrical contacts connected to the body and extended outwardly from the lower side.

11. The insulation piercing terminal in claim 9 further including:

two piercing members as the engaging means, and a conductor engaging channel between the two piercing members, the conductor engaging channel extending from the penetrating ends towards the lower side.

12. The insulation piercing terminal in claim 9 wherein the insulation piercing terminal is made of a continuous piece of electrically conductive metal.

13. The insulation piercing terminal in claim 9 wherein the insulation piercing terminal is made of a pre-tin plated phosphor bronze alloy.

14. The insulation piercing terminal in claim 9 wherein one or more of the securing ends extends further from the lower side then does the longest piercing member.

15. A method for assembling a member and a terminal including the following steps:

gathering a flexible conductive member, an insulation piercing terminal and an insulated wire;

placing the flexible conductive member between the insulation piercing terminal and the insulated wire;

penetrating through the flexible conductive member with the insulation piercing terminal;

piercing into the insulated wire with the insulation piercing terminal to engage the wire by piercing the insulation thereof for providing an electrically conductive connection wire therein, and shaping the insulation piercing terminal to secure, retain and compressively hold the insulated wire against the flexible conductive member.

16. The method for assembling a member and a terminal in claim 15 further including the step of covering the assembly with a non-conductive material.

17. The method for assembling a member and a terminal in claim 15 further including the step of sealing the assembly with a corrosion protective substance.

* * * * *